United States Patent [19]

Pool

[11] Patent Number: 4,682,708

[45] Date of Patent: Jul. 28, 1987

[54] INSULATED SHIPPING CONTAINER

[75] Inventor: Jerry S. Pool, High Point, N.C.

[73] Assignee: Leggett & Platt, Incorporated, Carthage, Mo.

[21] Appl. No.: 311,337

[22] Filed: Oct. 15, 1981

[51] Int. Cl.[4] ..... B65D 90/04

[52] U.S. Cl. ..... 220/460; 220/468

[58] Field of Search ..... 220/902, 441, 468, 460, 220/461, 462, 463, 402, 403; 206/524, 523, 594

[56] References Cited

U.S. PATENT DOCUMENTS 2,006,705 7/1935 Bangs ..... 220/463

2,954,140 9/1960 Sutherland et al. ..... 206/594

3,420,363 1/1969 Blickensderfer ..... 220/460

3,506,180 4/1970 Forrest ..... 220/460

*Primary Examiner*—Stephen Marcus

*Assistant Examiner*—Robert M. Petrik

*Attorney, Agent, or Firm*—Wood, Herron & Evans

[57] ABSTRACT

An improved paperboard shipping container having a relatively gas impervious lining or layer located exteriorly to an insulated cold or hot storage compartment comprised of sized panels of open-celled, non-rigid foamatious insulating material enclosing substantially all of the cold or hot storage compartment.

8 Claims, 2 Drawing Figures

INSULATED SHIPPING CONTAINER

BACKGROUND OF THE INVENTION

The invention relates to containers, and more particularly to an insulated container possessing impact cushioning characteristics with an improved ability to maintain a desired limited cold or hot temperature range for an extended period of time.

The shipment and handling of various goods and commodities, such as blood, drugs, vaccines, frozen foods, catalysts, chemicals, and the like, requires that the shipping container be well suited for cold or hot storage and that it have the ability to maintain the shipped product in a particular environment over a limited temperature range during the course of shipment and handling. In designing such a shipping container, the weight of the empty container is of significance; for instance, many perishable goods travel by air to distant destinations. The size and configuration of the container is also a design consideration, whether ground or air transportation is employed. The materials from which the container is constructed constitute a further factor in its design, since it is desirable to form the container from low cost materials which yield an easily assembled container which, where required, can be quickly disassembled for storage and/or re-shipment. It is further desirable to fabricate the container from materials which are relatively resilient to the customary impact shocks and blows encountered in shipment, and which provides satisfactory protection from damage incurred by the container through rough handling. A shipping container for cold or hot storage must therefore maximize the protection and preservation ability of the container, and minimize the cost and difficulty of construction of the container.

It is well known in the prior art to provide a shipping container with foam insulation as both the means to preserve a cold temperature storage environment within the container as well as protect the enclosed product from damage. In Cline et al, U.S. Pat. No. 3,416,692, a cold storage shipping container is disclosed which is semi-rigid and self supporting. The container has walls composed of a flexible and resilient foamed insulating material of an interconnected open-cell type which is enclosed within a fluid impervious casing, possessing a similarily composed cover. Since the walls and bottom of the container are an integral unit, the container cannot be knocked-down for storage or shipment. The container is typical of those types of shipping containers having walls composed of an insulating material encased between outer and inner walls. Such a container, though having flexible walls, is relatively expensive, since the encased insulation assembly is fairly elaborate. Further, this type of container must be purchased in assembled form, and cannot be compactly shipped or stored by the user for later assembly, as needed.

Likewise, it is known in the art to use an open-celled insulating foam material for insulating and protective purposes in containers. Such foam material as used in Cline, U.S. Pat. No. 3,416,692, is of an interconnected open-cell type, such as polyurethane, where the interstices between the foam cells reduce the circulation of gases from the colder interior compartment through to the outer warmer side of the container. However, the ability of such open-celled foam to hold a reduced temperature within a shipping container is far inferior to closed-cell foam such as polystyrene, which material has a relatively low susceptability to internal convective circulation or direct transmission of gases.

Ernst, et al, U.S. Pat. No. 3,890,762, shows a produce shipping container comprised of a common corrugated paperboard box and six closed-cell polystyrene foam panels, the six panels respectively residing in facial engagement with the sides, top, and bottom of the box. The panels are of a rigid foam, however, and thus provide a limited amount of protection to the contained product from damage through shipping and handling. Rigid panels of this type are also subject to chipping and breaking, which effectively degrades the container's ability to maintain a reduced interior temperature, and limits the commercial life of the container itself for re-use where desired.

The temperature preservation ability of the Ernst container further suffers from the employment of a type of closed-cell foam which will conduct the gases in the interior of the container to the ambient atmosphere or vice versa. The absence of an effective barrier to the flow of vapors between the interior and exterior of the container significantly reduces the shipping container's ability to maintain the requisite storage environment. In point of fact, the foam material specified in Ernst was selected for its ability to permit rapid temperature modification of the contained produce through cooling by an external source.

The prior art thus fails to provide an inexpensive and easily assembled light-weight, reusable shipping container having the improved ability to maintain a desired limited cold or hot temperature range over a long period of time while providing adequate cushioning and protection for the contained product.

SUMMARY OF THE INVENTION

The present invention solves these and other problems by providing in part a shipping containers which takes the best attributes of the simple and inexpensive paperboard box having foam insulation panels emplacable within it and combining them with the protective features of the open-celled flexible and resilient foam. The container can be manufactured at low cost from a minimum of elements, is easily assembled for use and is compactly storable for reshipment and storage, and provides good thermal and insulative qualities with an advantageous ability to maintain a cold or hot temperature environment over a limited range for an extended period of time, while further providing a protective and cushioning interior for the transported products.

In particular, the invention is directed to an insulated shipping container with an improved ability to hold a specified temperature range due, in part, to the introduction of a "vapor barrier" surrounding the interior storage compartment.

In accordance with the preferred form of the invention, the insulative layer of the shipping container comprises six non-integral panels or slabs of open-celled or inter-cellular foam, such as open-celled urethane foam. These slabs are sized to respectively match the interior surface of the bottom, sides, and top of a standard paperboard box, the box forming the exterior of the shipping container. These slabs are arranged within the interior of the box to form an insulative layer along the inside walls, top and bottom of the box and are sized to abut and compressively fit-against each other along their edges within the box, thereby supporting each other in place and creating an interior insulated storage compartment. The lack of any fixation means, such as gluing, to effect the emplacement of the insulative panels provides for a container that can be quickly assembled on site as needed from interchangable component parts, and that can be just as quickly disassembled for storage or re-shipment for re-use, features which add to the commercial desirability of the container.

A rigid load supporting panel is provided within the insulated storage compartment, and it is upon this load support that the shipped material rests. Refrigerant, such as dry ice, can be directly admitted to the compartment, or wet ice can be introduced in appropriate refrigerant containers to produce or promote the desired temperature to be maintained within the storage compartment. Eutectic alloys or solutions, such as those disclosed in Telkes, U.S. Pat. Nos. 2,677,367, 2,677,664, 2,936,741, and 2,989,856 can also be used to provide the temperature modification means within the storage compartment for temperature ranges between 0° F. and 150° F., with the specific temperature desired determining the choice of eutectic material.

The insulative panels are formed of a non-rigid, flexible and compressible foam which provides the necessary impact protection and resiliency needed to protect the transported products during handling and shipping. It has been discovered, and this invention is predicated upon, the discovery that a vapor barrier surrounding the cold storage compartment formed by the open-celled insulative slabs effectively and efficiently increases the ability of the open-celled foam to maintain the desired temperature range.

The vapor barrier envisioned in the preferred embodiment of the invention consists of a plastic bag which is placed between the foam insulation slabs forming the storage compartment and the interior walls of the paperboard box. In use, the bag is placed within the box and the side and bottom panels of insulation are appropriately arrayed around the inside of the bag within the box. When the load supporting panel, product and coolant or heat source have been placed within the compartment, the top panel of insulation is then set in place, and the plastic bag folded shut, thereby forming a continuous vapor barrier on the outside of the storage compartment formed by the panels. The box can then be conventionally sealed. It should be noted that the plastic bag is not sealed to allow $CO_2$ gas to escape when dry ice is used as a refrigerant.

It will be recognized that although this preferred embodiment has been described as employing a plastic bag as a vapor barrier surrounding the cold storage compartment, any similar type of vapor transmission inhibiting means can be employed.

Attention is now called to the description with reference to the accompanying drawings which shows an improved insulative shipping container in accordance with a preferred embodiment of the invention.

DETAILED DESCRIPTION OF THE INVENTION

Figure 1:
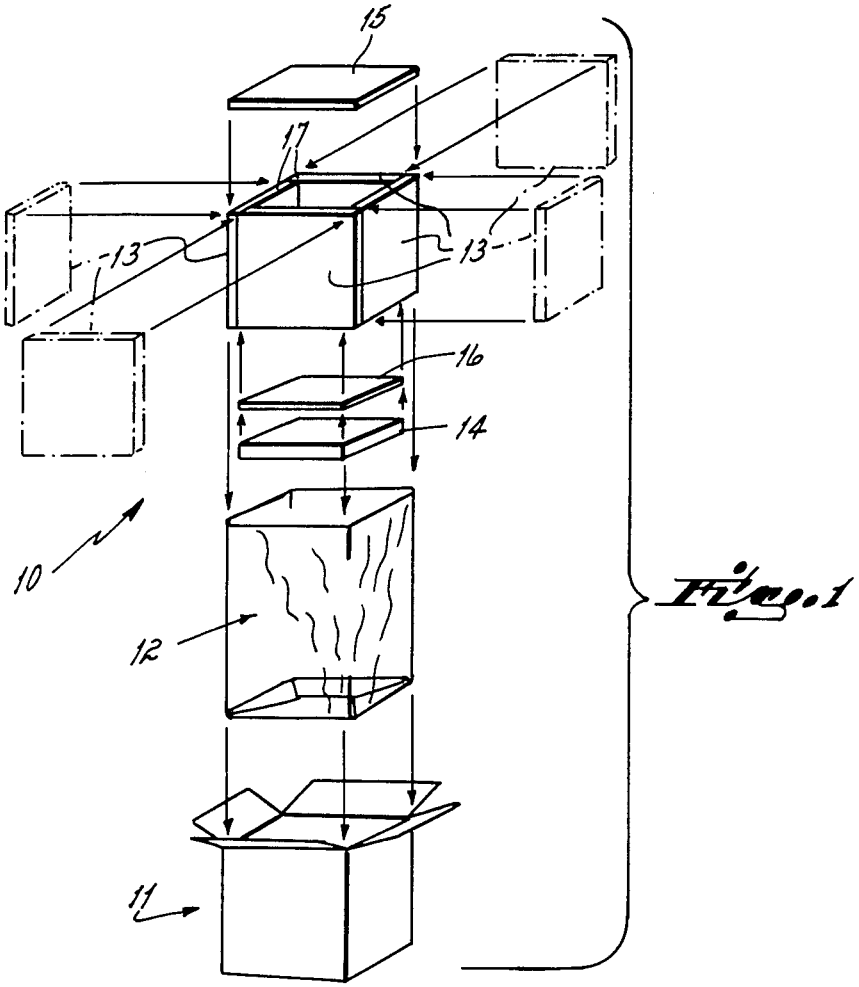
FIG. 1 is an exploded perspective view of the insulated container of this invention showing the arrangement of the bag, insulative panels, and load support within the paperboard box.

As shown in FIG. 1, a shipping container 10 is comprised of three basic elements which are assembled to form the improved insulative container of this invention. The outermost component of the insulated container is the paperboard box 11 which is conventional in form and well known in terms of construction to those skilled in the art. Located interiorly to and within the box is a plastic bag 12 which forms the vapor barrier of the invention. The plastic bag is also of conventional fabrication, preferably consisting of polyethylene film having thickness of approximately 2 mills.

Emplaced within the plastic bag 12 and within the cardboard box 11 is an insulative layer formed of six foam slabs or panels, which are non-integral with each other and which are placed separately within the bag 12 and box 11 upon assembly of the container. The panels are composed of an open-celled flexible, compressible and resilient foam, such as urethane foam, and include four side panels 13, a bottom panel 14 and a top panel 15. The panels are all sized to fit within the bag and box so as to meet along adjacent edges in abutting relationship. In such a configuration, the panels compressible contact each other along the side edges, thereby providing support, one against the other, thus maintaining the panels in a relatively fixed position within the bag and box. This facilitates both the assembly of the insulative shipping container and the loading of the same. A rigid load support 16 is provided for the bottom of the container to receive the product or products which are to be shipped as well as any refrigerant or heat source which is to be carried by the container.

Figure 2:
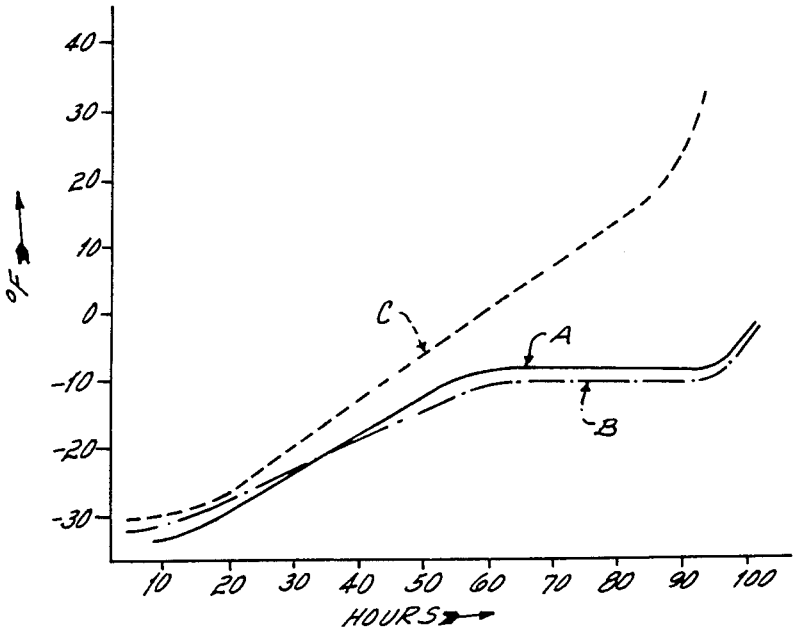
FIG. 2 is a graphical representation of the cold temperature holding abilities of closed-celled polystyrene, and open-celled urethane with and without an exterior vapor barrier.

As FIG. 2 shows, the introduction of a vapor barrier located exterior to the open-celled foam significantly increases the ability of the storage compartment to maintain a desired temperature environment. Flexible, open-celled urethane foam (line A) provided with such an exterior vapor barrier formed from a 2 mill polyethylene film effectively matches the holding characteristics of the rigid closed-celled polystyrene foam (line B). Open-celled urethane foam without an associated vapor barrier is significantly less able to hold or maintain a limited temperature range (line C). Thus, the use of the vapor barrier in conjunction with the flexible, compressible open-celled foam yields a storage compartment which effectively combines the thermal insulative abilities of the closed-celled polystyrene with the damage resistant, product-protective features of the flexible foam.

The assembly of the insulated shipping container is quickly and easily accomplished. First, an appropriate paperboard box-blank is erected to form the box 11. The plastic bag 12 is next inserted through the open top of the box 11, and opened and spread out to roughly follow the interior contour of the box. The side panels of insulation 13 are next inserted and arranged in the previously described edge-abutting fashion along the interior of the bag and box. The bottom panel of insulation 14 is then set between the four side panels 13 and pressed to the bottom of the box 11, its edges in abutting contact with the adjacent side panels 13. Next, the rigid load support 16 is positioned on top of the bottom panel 14. The product and refrigerant or heat source (not shown) are then placed within the storage compartment. The storage area thus formed is then closed by emplacement of the top panel 15 which is set upon the upwardly extending side edges 17 of the side panels 13, such that the top panel 15 effectively encloses the storage compartment. The emplacement and positioning of the respective panels within the bag and box advantageously requires no fixation means, the panels maintained in place through compression forces exerted on the edges of the panels, one with another and against the bag and interior of the paperboard box.

Once the top panel 15 has been emplaced and the storage compartment closed, the plastic bag 12 is then folded over thereby creating a vapor barrier surrounding the entire cold storage compartment. The paperboard box 11 may be sealed by conventional means, such as by taping shut.

As easily as the insulative container 10 of this invention is assembled, it is just as quickly disassembled for storage or compact re-shipment. All of the components of the container can be folded and stacked into a neat, lightweight planar package which is easily transportable for re-shipment or re-use, or easily stored for re-use in the future.

It can thus be seen that this invention provides an insulated shipping container which can be manufactured at low cost from a minimum of elements and is easily assembled and disassembled by the user as needed, and which provides good thermal and protective qualities with an advantageous ability to hold a desired limited temperature range for an extended period of time. While the principles of the invention have now been made clear in an illustrative embodiment, there will be immediately obvious to those skilled in the art man modifications in the practice of the invention which can be accomplished without departing from those principles.

I claim:

1. An improved lightweight insulated shipping container for cold or hot storage having low thermal conductivity comprised of:

a box having a bottom, side walls and a top, said top cooperating with said side walls to form a closure for said box, an insulated layer located interiorly to said box, said interior layer being composed of at least three panels of open-celled flexible and resilient foam, said panels being sized to fit the interior contours of said bottom, side walls, and top, said panels forming an insulative storage compartment in said box, a vapor barrier surrounding and enclosing said insulative storage compartment and located exteriorly to said panels.

2. A shipping container of claim 1 wherein said box is made of paperboard.

3. The shipping container of claim 1 wherein said box is a rectangular box.

4. The shipping container of claim 1 wherein said vapor barrier comprises a plastic bag, which bag is set within said box and encompasses and encloses said insulative panels.

5. The shipping container of claim 1 wherein said insulative panels are unattached, said panels being held in place by compression along adjacent abutting edges.

6. The insulative container of claim 3 wherein said insulative panels are six separate panels.

7. The shipping container of claim 1 wherein said open-celled foam is a urethane foam.

8. An improved insulated shipping container for cold or hot storage comprised of:

a rectangular paperboard box having a bottom, side walls, and a top, said top cooperating with said side walls to form a closure for said box, an insulative layer located interiorly to said box, said insulative layer being composed of six panels of open-celled flexible and resilient foam, said panels being sized to fit the interior contours of said bottom, side walls, and top, said panels being held in place by compression along adjacent abutting edges, said panels forming an insulative storage compartment within said box, a vapor barrier surrounding and enclosing said insulative storage compartment and located exteriorly to said panels, the vapor barrier being composed of plastic bag located interiorly to said paperboard box.

* * * * *